US005966875A

United States Patent [19]

Kuhns

[11] Patent Number: 5,966,875

[45] Date of Patent: Oct. 19, 1999

[54] RAIN GUTTER PROTECTOR CLIPS

[76] Inventor: Richard L. Kuhns, 210 Broad St., Red Bank, N.J. 07701

[21] Appl. No.: 08/906,798

[22] Filed: Aug. 5, 1997

Related U.S. Application Data

[60] Provisional application No. 60/023,452, Aug. 6, 1996.

[51] Int. Cl.[6] ..... E04D 13/076

[52] U.S. Cl. ..... 52/12; 52/712

[58] Field of Search ..... 52/12, 712

[56] References Cited

U.S. PATENT DOCUMENTS

| | | | |
|---|---|---|---|
| 3,067,881 | 12/1962 | Goosmann | 52/12 X |
| 3,351,206 | 11/1967 | Wennerstrom | 52/12 X |
| 3,834,091 | 9/1974 | Dugan | 52/12 |
| 4,036,761 | 7/1977 | Rankin | 52/12 |
| 4,467,570 | 8/1984 | Kriegel | 52/12 |
| 4,750,300 | 6/1988 | Winger, Jr. | 52/12 |
| 4,888,920 | 12/1989 | Marulic | 52/12 |
| 5,660,001 | 8/1997 | Albracht | 52/12 |

*Primary Examiner*—Christopher T. Kent
*Attorney, Agent, or Firm*—Thomason Moser & Patterson

[57] ABSTRACT

An apparatus for securing a gutter protector to a rain gutter. More particularly, the apparatus is a fastening clip that is easily applied to fasten the gutter protector to the rain gutter.

14 Claims, 7 Drawing Sheets

RAIN GUTTER PROTECTOR CLIPS

This application claims the benefit of U.S. Provisional Application No. 60/023,452 filed Aug. 6, 1996.

The present invention relates to an apparatus for securing a gutter protector to a gutter. More particularly, this invention relates to a fastening clip that is easily applied to fasten the gutter protector to the gutter.

BACKGROUND OF THE INVENTION

In U.S. Pat. Nos. 5,216,851 and 5,339,575 dated Jun. 8, 1993 and Aug. 23, 1994, new and novel rain gutter protectors were disclosed. Such devices utilize surface tension to cause rain water to flow from the roof surface onto a flat portion of the rain gutter protector covering the gutter. The rain water is directed to an arcuate surface causing the water flow to change to a vertical downward direction. In turn, a series of louvers (apertures) located in the front vertical portion of the rain gutter protector directs the rain water into the gutter, while debris of sufficient size are excluded from entering therein. Thus, gutters remain clean and free flowing, thereby eliminating the chore of manual cleaning. Generally, devices embodying these patents are made of aluminum and are successfully marketed under the trademarks "Waterloov" and "Care-Free."

However, for similar devices made of plastic, the fastening techniques of applying a metal screw through the lip of the gutter and into the flange of the rain gutter protector may cause the plastic to crack or break. The breakage is due to the differences in expansion characteristics between the aluminum gutter to which the plastic rain gutter protector is affixed. The opposite is also true of aluminum rain gutter protectors mounted on plastic guttering.

Additionally, rain gutter protectors embodying these patents are usually installed by trained technicians instead of homeowners and unskilled tradesmen. U.S. Pat. Nos. 5,216,851 and 5,339,575, (the disclosures of which are hereby incorporated by reference) describe rain gutter protector devices configured to form a closed top surface which is affixed to the gutter by positioning a flange under the gutter lip and fastened with screws or some such fasteners. The method of fastening the protector to the guttering requires an installer to hold and align the protector in position while fastening the protector, thereby limiting installation to trained skilled installers.

As aforementioned, the problems and annoyances involved in the installation of rain gutter protectors are common knowledge. The prior art solution of fastening protectors directly to the rain gutter itself is often time consuming and difficult. The installation requires the interfitting of the rain gutter protector to the roofing first and then aligning the protector to the underside of the top gutter lip, thereby stabilizing the protector to receive a fastener through both the gutter lip and the flange of the rain gutter protector. It can become a dangerous juggling act for an inexperienced homeowner at considerable height.

Therefore, a need exists in the art for an apparatus to increase the ease of installing protectors onto existing guttering, while accommodating any physical changes which may occur after installation such as thermal expansion.

SUMMARY OF THE INVENTION

Embodiments of the present invention provide a fastening clip for use with plastic and/or metal rain gutter protectors having a flat portion that extends from the top of the gutter lip through the bottom most aperture of the rain gutter protector. The fastening clip enters into the gutter where at a rear most portion of the protector flange, said clip has a curved portion that curves downward in an arc, e.g., approximately 195 degrees, and extends to the innermost lower edge of the top portion of the front gutter lip. A nodule lodges against the edge of the inside gutter lip or front most edge of the rain gutter protector to cause the clip to lock into position.

The flat portion of the clip also optionally includes a hole for fastening the clip to the top of the gutter lip with rivets, screws, or some other fasteners to keep said clip from working loose from forces such as wind and the weight of snow and ice that may cause the protector to loosen. Alternatively, the hole can be positioned on the clip such that it will permit the clip to be fastened to the front portion (front edge) of the rain gutter lip.

In another embodiment, a fastening clip has a flat portion and a curved portion that is not inserted through an aperture of the rain gutter protector. More specifically, the flat portion extends across the top of the gutter lip, while the curved portion extends around and beneath the gutter lip and then extends around and underneath a flange of the gutter protector. This embodiment avoids the necessity of having to pass the fastening clip through an aperture of the rain gutter protector.

Furthermore, the flat portion of the clip also extends away from the gutter lip to facilitate grasping of the clip until the clip is fastened, at which point the excess flat portion can be broken off or removed.

BRIEF DESCRIPTION OF THE DRAWINGS

The teachings of the present invention can be readily understood by considering the following detailed description in conjunction with the accompanying drawings, in which.

DETAILED DESCRIPTION

In accordance with the present invention, a fastening clip is provided that is used in conjunction with rain gutter protectors to be installed on new or existing guttering. In two embodiments, the fastening clip is slid through the aperture of the rain gutter protector before the panel is interfitted with the roofing. The rain gutter protector is pulled into position and aligned with the rain gutter, thereby providing an easy method of fastening the rain gutter protector to the rain gutter. Thus, the rain gutter protectors are easily installed generally by one unskilled person. Additionally, the rain gutter protector can be easily removed and replaced with new clips without damaging roofing or guttering.

In a third embodiment, the fastening clip is slid around and beneath the gutter lip and then around and beneath a flange of the gutter protector. This third embodiment avoids the necessity of having to pass the fastening clip through an aperture of the rain gutter protector.

More specifically, FIGS. 1–4 show the fastening clip 4 which embodies the present invention as used with a single row or double row louvered rain gutter protectors. However, those skilled in the art will realize that the present invention can be applied to a gutter protector with any number of rows of louvers, including gutter protectors that provide no louvers that are proximate to the lip of the rain gutter.

Figure 1:
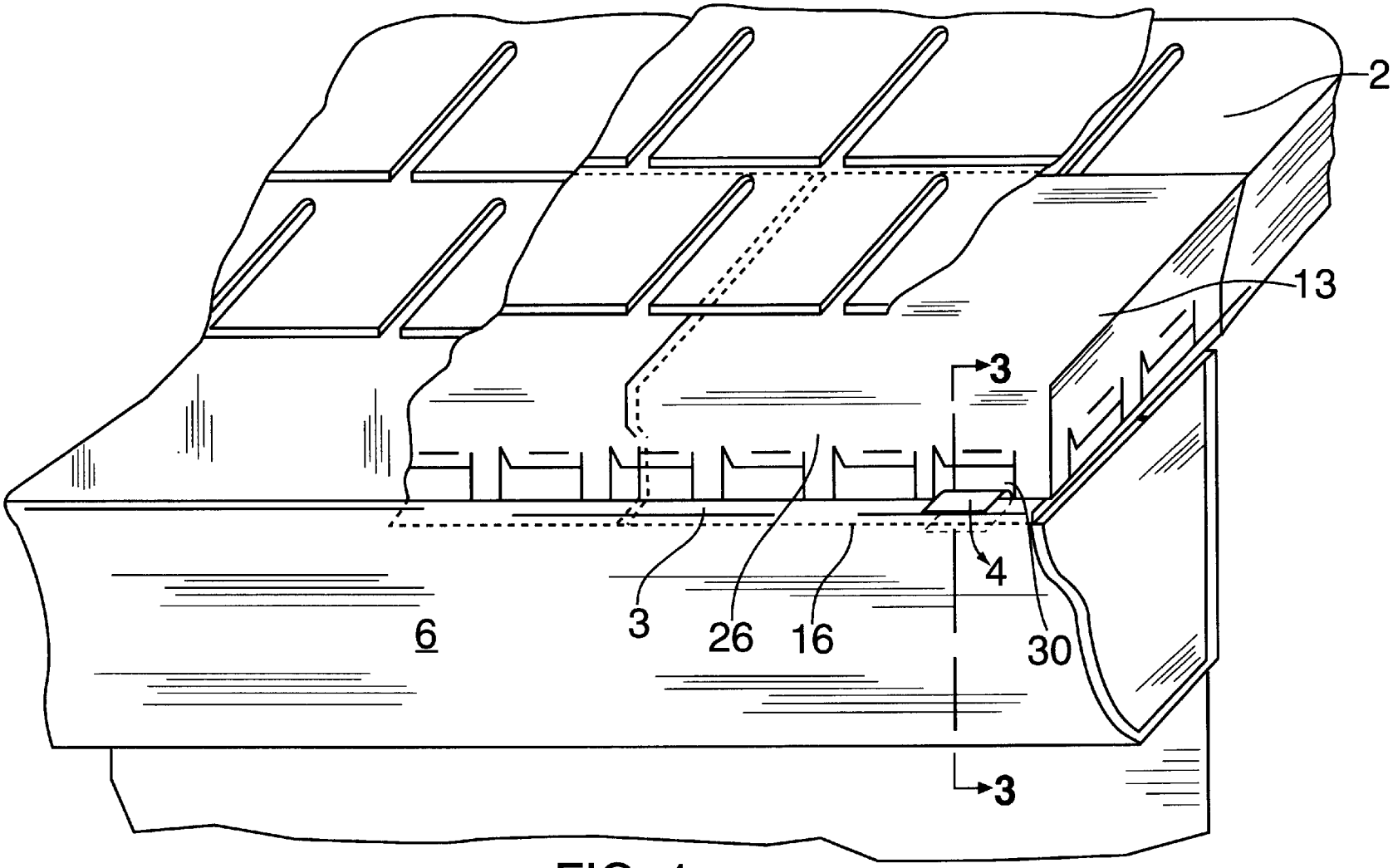
FIG. 1 is a perspective view of a first embodiment of the present invention as utilized with a louvered rain water collector.
Figure 3:
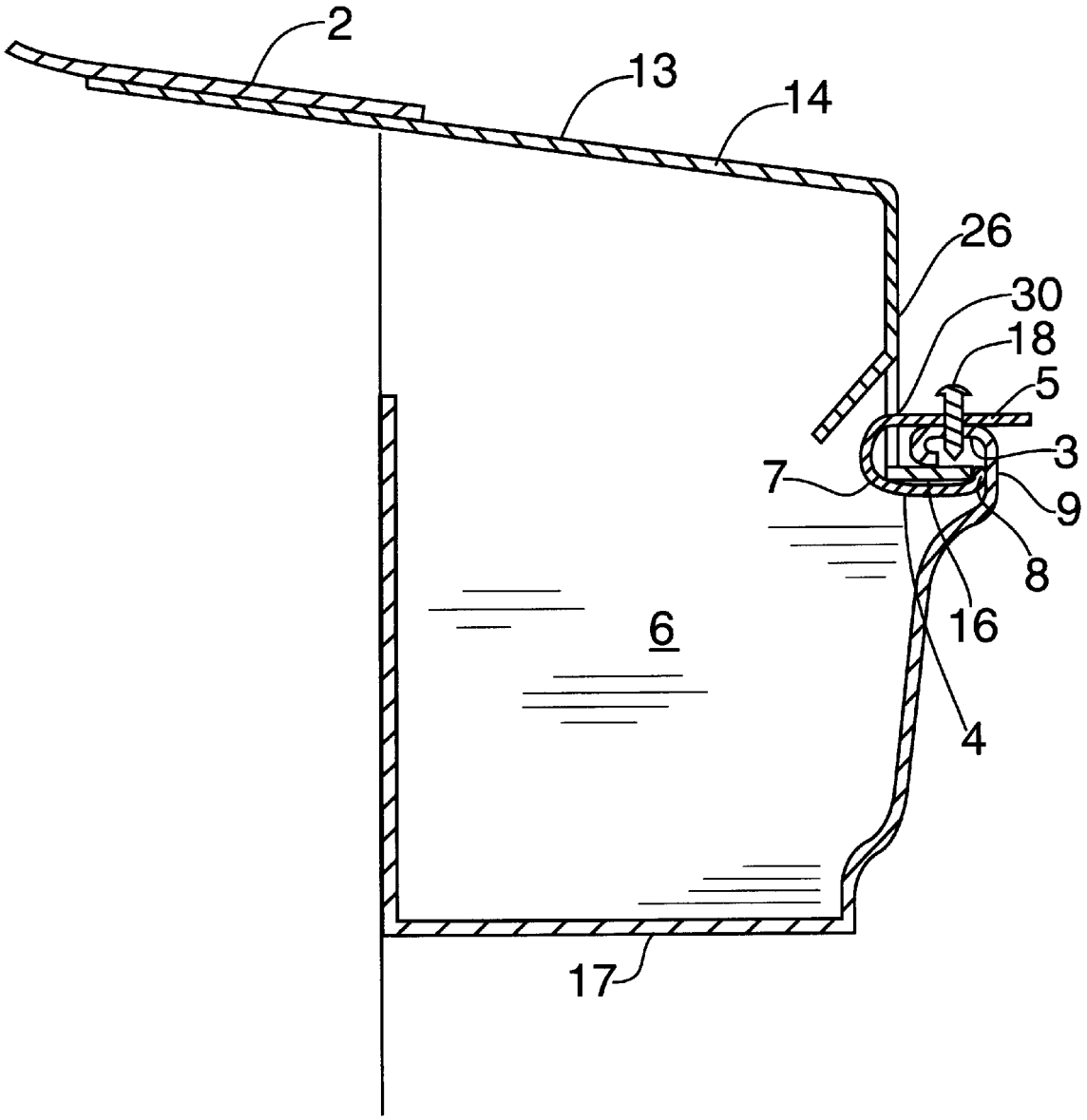
FIG. 3 is a sectional view of the first embodiment of the present invention taken along Line 1—1 of FIG. 1.
Figure 5:
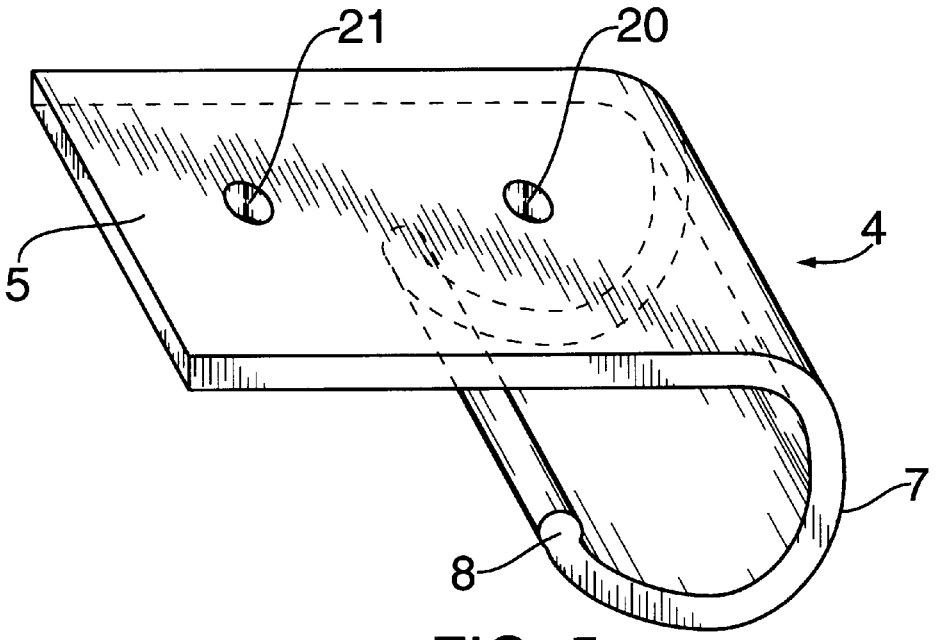
FIG. 5 is a perspective view of the first embodiment of the present invention.

FIG. 1, FIG. 3 and FIG. 5 collectively illustrate a first embodiment of the present invention. In general, the rain gutter protector 13 may comprise a top portion 14, a vertical portion 26 and a flange 16, while the rain gutter 6 typically comprises a trough 17, a front edge 9 extending from one side of the trough 17, and a rain gutter lip 3 extending from the front edge 9. This general description of the configuration of the rain gutter protector and the rain gutter serves as the basis for the discussion of various embodiments below.

Furthermore, the flange 16 in a gutter protector typically extends a short distant away from the vertical portion 26, i.e., flange 16 has a short length. However, if a gutter protector has no such flange, then for the purpose of the discussions and the claims below, the flange is simply the end of the vertical portion 26 having a length equal to the thickness of the vertical portion 26. In other words, the length of the flange 16 may range from the thickness of the vertical portion 26 to some predefined length specified by a gutter protector manufacturer. Thus, rain gutter protectors 13 shown in FIG. 1 and FIG. 3 are interfitted with roofing 2, and extends to the front of the rain gutter 6 with a vertical portion 26 extending down to a lower most portion of the rain gutter lip 3.

Similarly, the lip 3 in a rain gutter 6 typically extends a short distant away from the vertical edge 9, i.e., lip 3 has a short length. However, if a rain gutter has no such lip, then for the purpose of the discussions and the claims below, the lip is simply the end of the vertical edge 9 having a length equal to the thickness of the vertical edge 9. In other words, the length of the lip 3 may range from the thickness of the vertical edge 9 to some predefined length specified by a rain gutter manufacturer.

The fastening clip 4 shown in FIG. 5 has a general flat portion 5 and a curved portion 7. The general flat portion 5 is approximately ½" to ¾" in width and its thickness (e.g., approximately 1/64" to ¼") can be selected such that it is sufficient for its material of construction (either plastic or noncorrosive metal) to retain memory of shape and to provide sufficient strength to secure the rain gutter protector 13 as shown in FIG. 1 and FIG. 3 in a stationary position.

The fastening clip 4 shown in FIG. 3 extends or rests from approximately ¾" beyond and over the outside top most portion of the rain gutter lip 3 of rain gutter 6 and passes through the rain gutter protector louver (aperture) 30 of rain gutter protector 13. The flat portion 5 curves down as shown in a curved portion 7 of the clip and extends from the back portion of the protector flange 16 to the front portion of same flange, where the clip 4 has a nodule 8 which locks into the front most edge of flange 16. A screw 18 or some other suitable types of fastener such as pop rivets is applied through aperture 20, as shown in FIG. 5, to optionally fasten the flat portion 5 of the clip 4 to the top portion of the rain gutter lip 3. Once the clip is fastened to the rain gutter lip, the flat portion of the clip extending beyond the front most edge of the rain gutter lip 3 of FIG. 3 may be cut and removed from the clip 4.

Alternatively, in situations that do not allow physical access to position fastener 18, as shown in FIG. 3, the flat portion 5 of the clip 4, instead of being removed, can be bent down along the front edge of the rain gutter lip 3 and similarly fastened to the front edge 9 of the rain gutter lip through aperture 21 as shown in FIG. 5.

Figure 2:
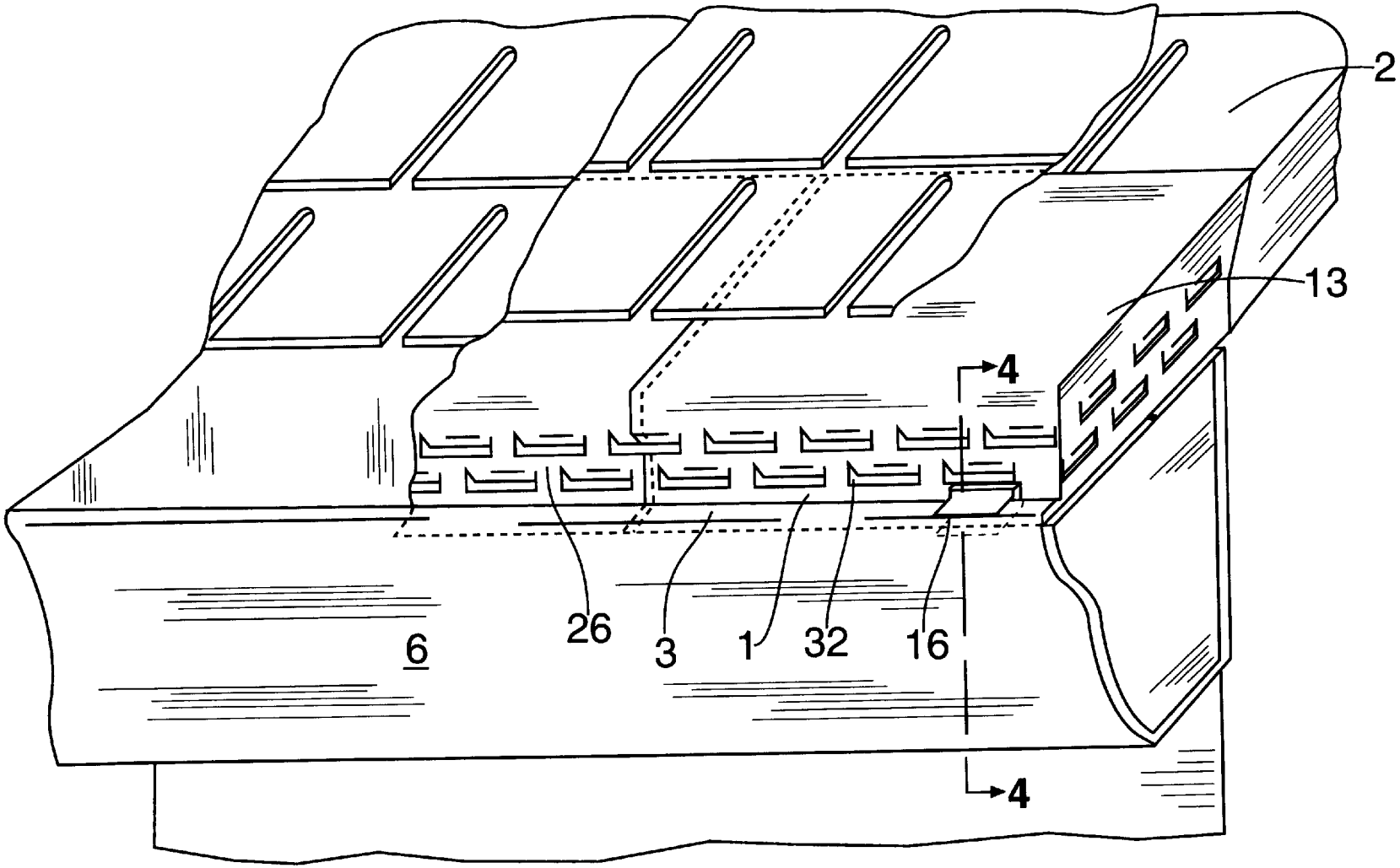
FIG. 2 is a perspective view of a second embodiment of the present invention as utilized with a louvered rain water collector with a wall.
Figure 4:
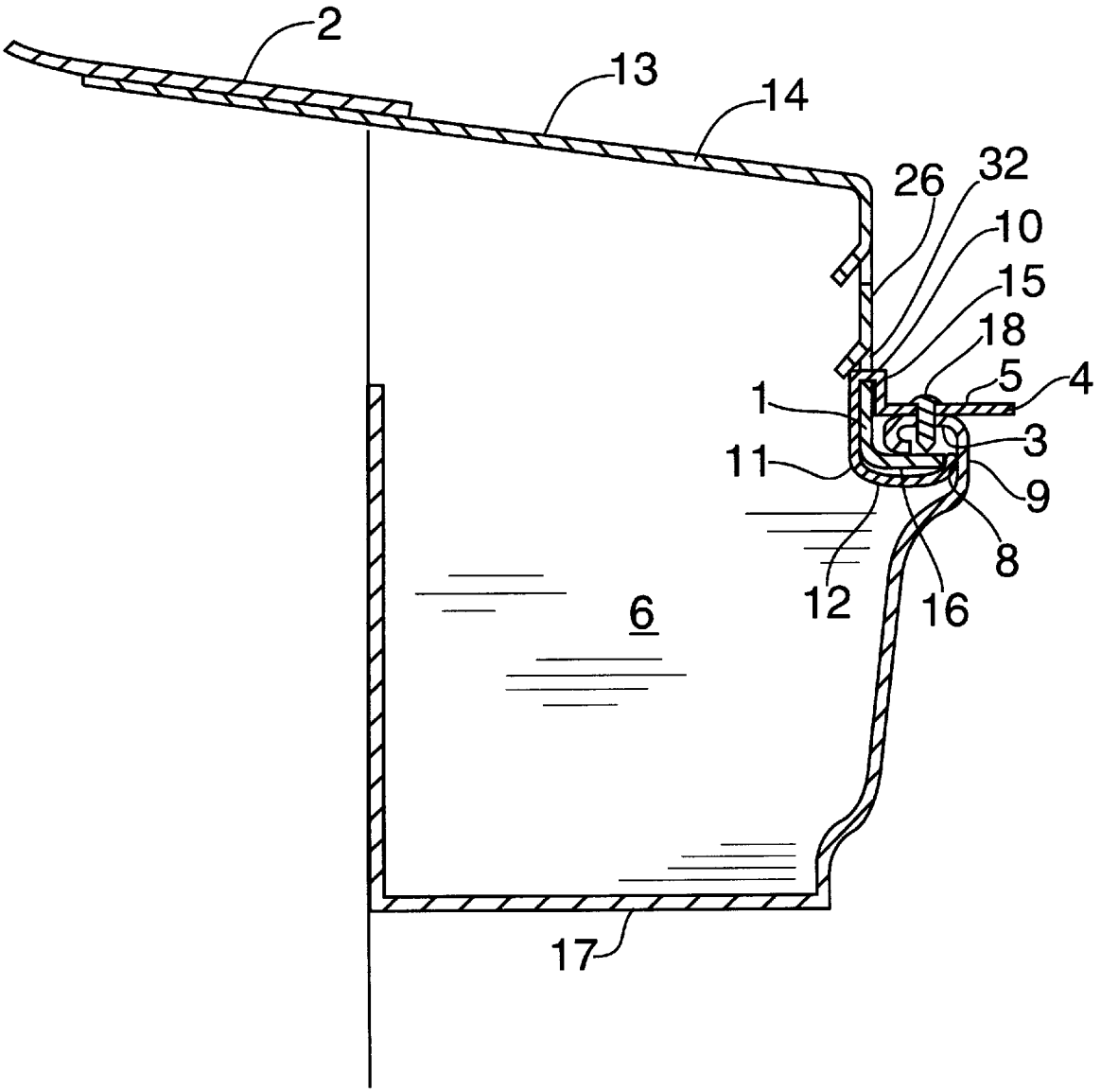
FIG. 4 is a sectional view of the second embodiment of the present invention taken along Line 2—2 of FIG. 2.
Figure 6:
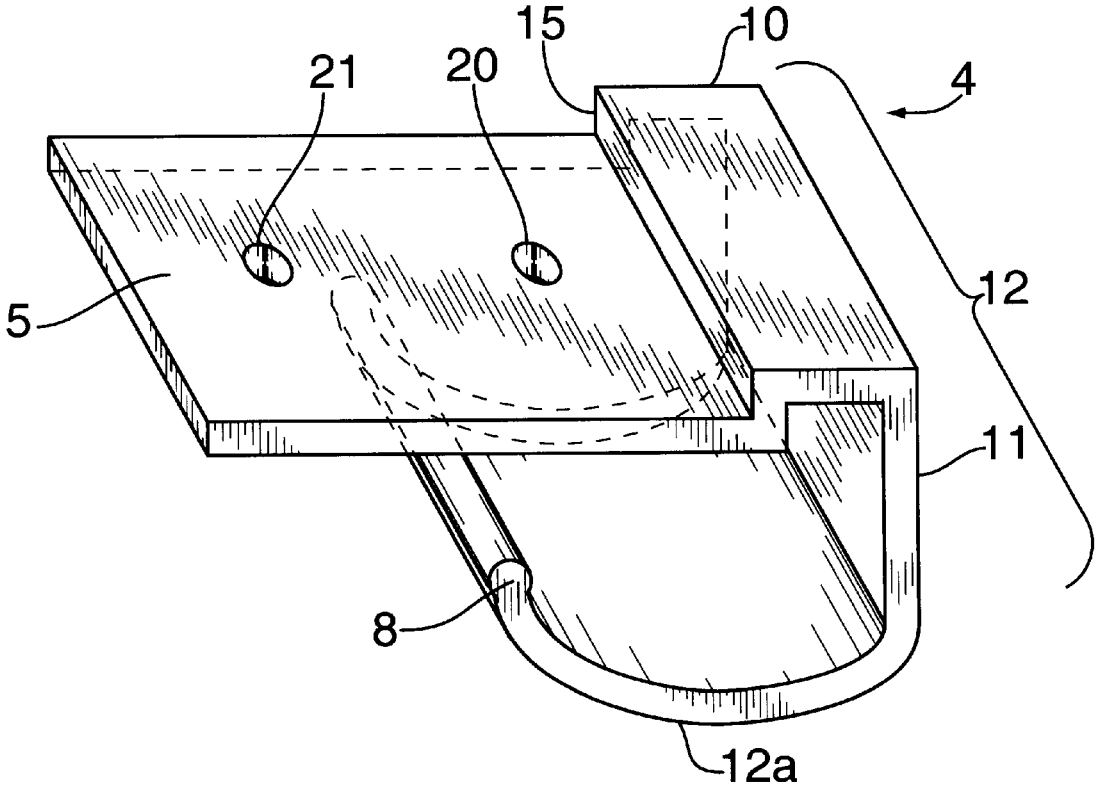
FIG. 6 is a perspective view of the second embodiment of the present invention.

FIG. 2, FIG. 4 and FIG. 6 collectively illustrate a second embodiment of the fastening clip 4 which embodies the present invention. Rain gutter protector 13 shown in FIG. 2 and FIG. 4 is interfitted with roofing 2, and extends to the front of the rain gutter 6 with a vertical portion 26 extending down to the lower most portion of rain gutter lip 3.

The clip 4 of FIG. 6 has a general flat portion 5 and a curved portion 12. The curved portion 12 includes sides 10, 11, 15 and 12*a*. It should be understood that although FIG. 4 and FIG. 6 illustrate straight sides 10, 11, and 15, these sides can be implemented as a continuous part (not shown) of curved portion 12*a,* i.e., curved portion 12 will have a shape that resembles a laterally flipped "C".

More specifically, the general flat portion 5 is approximately ½" to ¾" in width and its thickness (e.g., approximately 1/64" to ¼") can be selected such that it is sufficient for its material of construction (either plastic or noncorrosive metal) to retain memory of shape and to provide sufficient strength to secure the rain gutter protector 13 in a stationary position as shown in FIG. 2 and FIG. 4. The fastening clip 4 extends from approximately ¾" beyond and over the outside top most portion of the rain gutter lip 3 of rain gutter 6 to the lower most wall 1 of the rain gutter protector as shown in FIG. 4. A vertical edge 15 of the clip 4 extends upward to the top most portion of the wall 1, where a horizontal portion 10 passes through louver (aperture) 32 of the rain gutter protector. A vertical portion 11 of the clip 4 then extends down the inner most portion of said wall 1 to the bottom most portion of rain gutter protector flange 16. A curved portion 12 of the clip 4 extends from the back portion of the protector flange 16 to the front portion of same flange where the clip 4 has a nodule 8 which locks into the front most edge of flange 16. A screw 18 or some other type of fastener such as pop rivets is optionally used to fasten flat portion 5 of the clip 4 through aperture 20, as shown in FIG. 6, to the top portion of the rain gutter lip 3. Once the clip is fastened to the rain gutter lip, the flat portion of the clip extending beyond the front most edge of the rain gutter lip 3 may be cut and removed from the clip 4.

Alternatively, in situations that do not allow physical access to position fastener 18, as shown in FIG. 2 and FIG. 4, this flat portion 5 of the clip, instead of being removed, can be bent down along the front edge of the rain gutter lip 3 and similarly fastened to the front edge 9 of the rain gutter lip through aperture 21.

Figure 7:
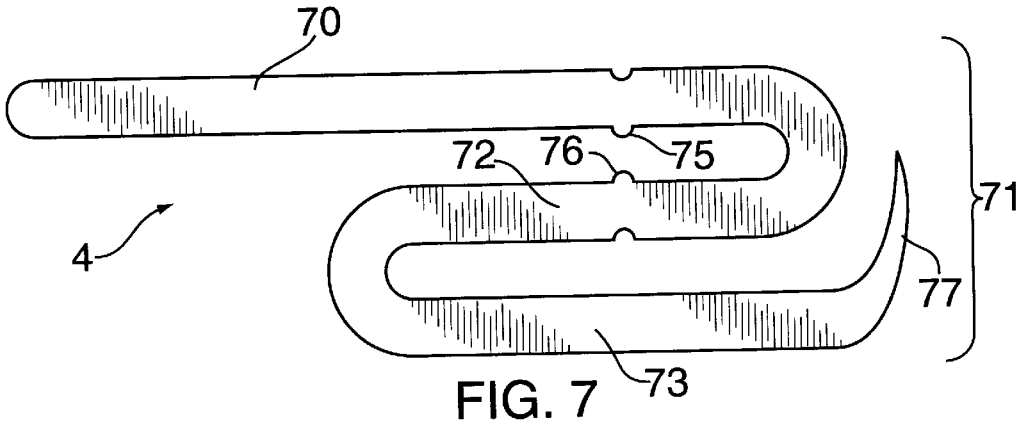
FIG. 7 is a side view of a third embodiment of the present invention.
Figure 8:
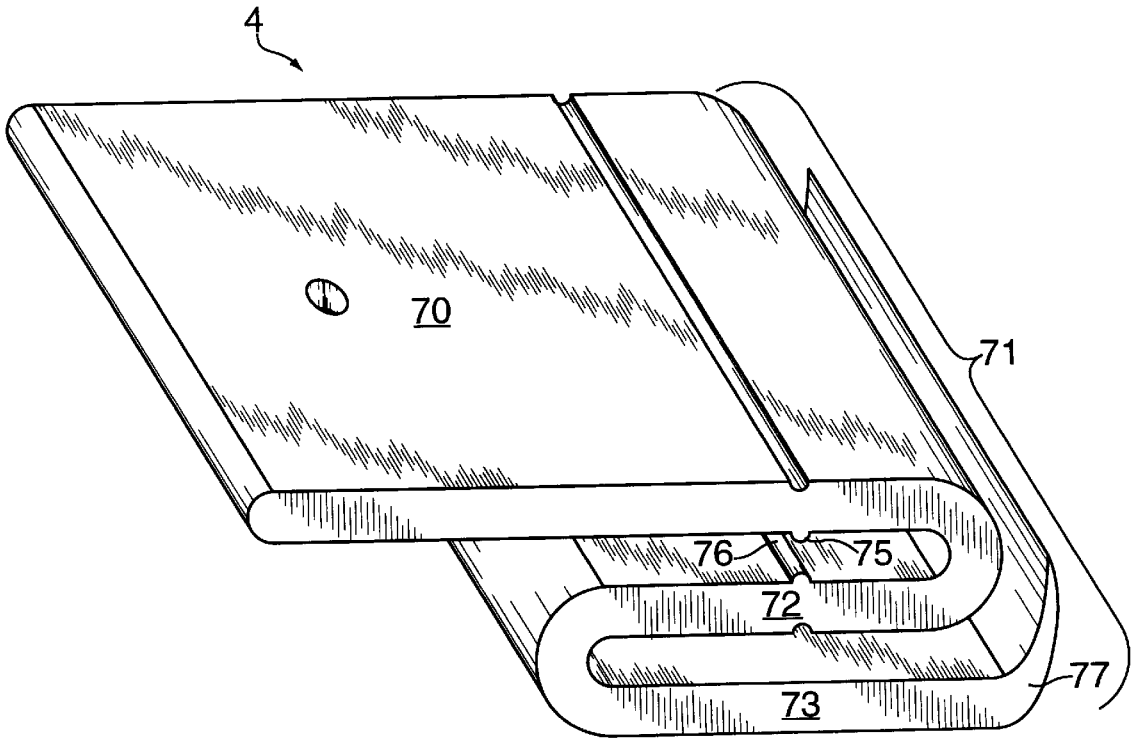
FIG. 8 is a perspective view of the third embodiment of the present invention.
Figure 9:
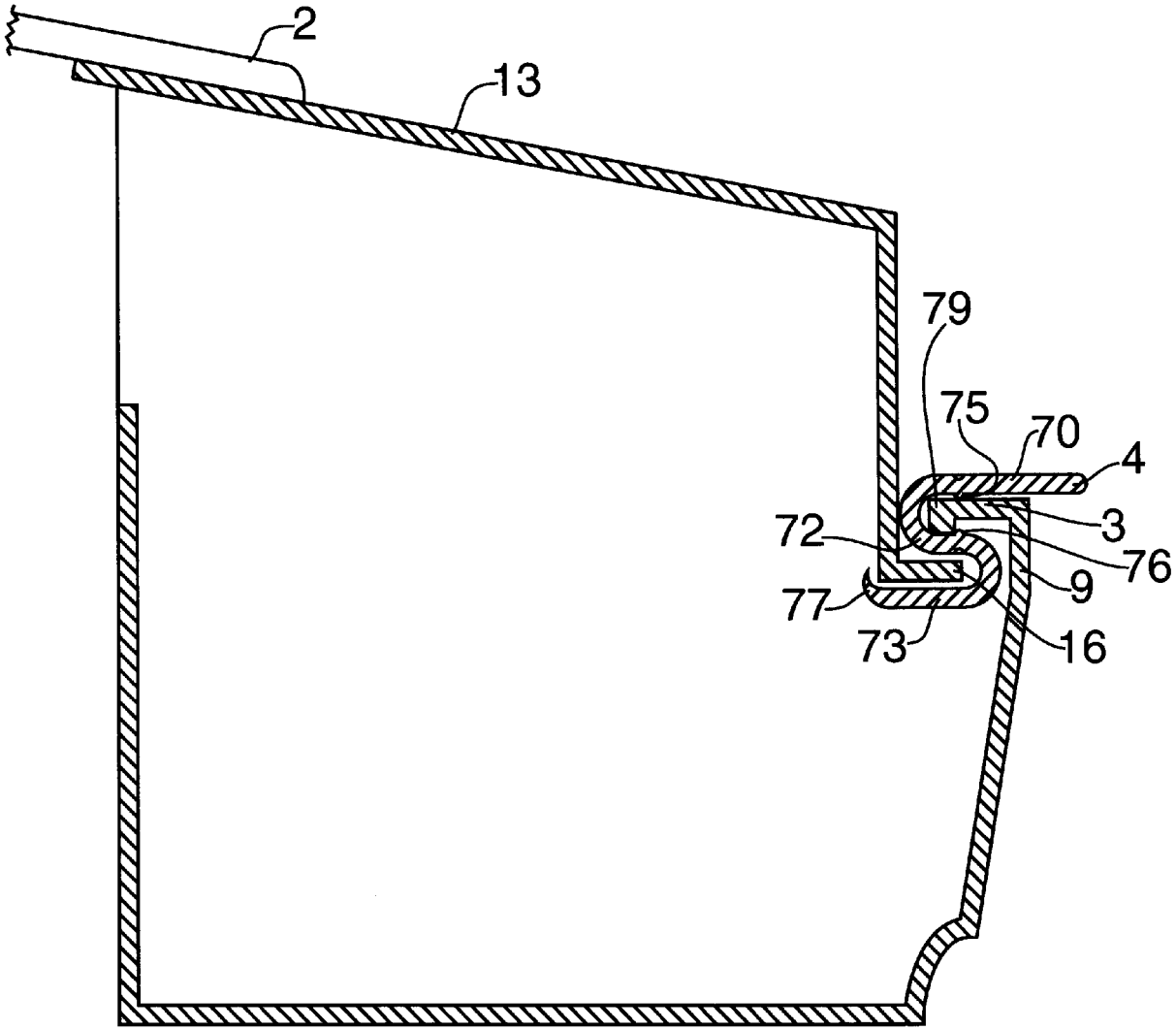
FIG. 9 is a sectional view of the third embodiment of the present invention of FIG. 7 showing the clip as used with a gutter protector and a gutter.

FIGS. 7–9 collectively illustrate a third embodiment of the fastening clip 4 which embodies the present invention. Rain gutter protector 13 shown in FIGS. 7–9 is interfitted with roofing 2, and extends to the front of the rain gutter 6 with a vertical portion 26 extending down to the lower most portion of rain gutter lip 3.

The clip 4 of FIG. 7 has a general flat portion 70 and a curved portion 71. The curved portion 71 includes sides 72, 73 and 77.

More specifically, the general flat portion 70 is approximately ½" to ¾" in width and its thickness (e.g., approximately 1/64" to ⅛") can be selected such that it is sufficient for its material of construction (either plastic or noncorrosive metal) to retain memory of shape and to provide sufficient strength to secure the rain gutter protector 13 in a stationary position as shown in FIG. 9. The flat portion 70 of the fastening clip 4 extends from approximately ¾" beyond and over the outside top most portion of the rain gutter lip 3 of rain gutter 6, while the curved portion 71 extends around and beneath the gutter lip 3.

More specifically, a first side 72 of the curved portion 71 extends around and beneath the gutter lip 3, while a second side 73 of the curved portion 71 extends around and underneath a flange 16 of the gutter protector 13. Namely, second side 73 extends from the front portion of the protector flange 16 to the back portion of same flange. In turn, a third side 77 extending from the second side 73, has a "hook shaped end" that locks into the back most edge of flange 16. In this fashion, this third embodiment avoids the necessity of having to pass the fastening clip 14 through an aperture of the rain gutter protector 13.

Furthermore, a first nodule 75 located on the flat portion 70 and a second nodule 76 located on the first side 72 of the curved portion 71 are employed to lock the rain gutter lip 3 to the protector flange 16. Since the fastening clip 4 of FIGS. 7–9 can be formed using spring steel, these nodules 75 and 76 collectively exert a clamping force on the rain gutter lip 3, thereby securing the rain gutter lip to the protector flange 16.

Alternatively, if the rain gutter lip 3 employs a nodule end 79, then the first nodule 75 can be optionally omitted. This omission is permitted since the second nodule 76 can be locked to the nodule end 79 of the rain gutter lip 3, thereby providing the necessary pressure to hold the rain gutter lip 3 to the protector flange 16.

Similar to the above embodiments, a screw 18 (not shown) or some other type of fastener such as pop rivets can be optionally used to fasten flat portion 70 of the clip 4 through aperture (not shown), to the top portion of the rain gutter lip 3. Once the clip is fastened to the rain gutter lip, the flat portion of the clip extending beyond the front most edge of the rain gutter lip 3 may be cut and removed from the clip 4.

Again, in situations that do not allow physical access to position fastener 18, this flat portion 70 of the clip 4, instead of being removed, can be bent down along the front edge of the rain gutter lip 3 and similarly fastened to the front edge 9 of the rain gutter lip through an aperture (not shown).

In summary, the present invention includes a clip specially formed and constructed of plastic, vinyl or of a metal such as aluminum or spring steel. The clip can be slid through an aperture of the rain gutter protector or beneath the rain gutter lip and is used to align the protector to the gutter lip and then to hold the protector in position as the clip is then fastened to the rain gutter.

It is evident to those skilled in the art that this clip can be modified to adopt to situations where access to the top edge of the gutter lip is nonexistent to provide a method of fastening the protector to the front edge of the gutter lip. The clip described above has a length of approximately 1/12" and a width of approximately ½" to ¾". However, the present invention is not so limited and it should be understood that the present invention can be implemented and modified with different dimensions to accommodate gutter protectors and rain gutters of different sizes and shapes.

There has thus been shown and described a novel apparatus for securing a gutter protector to a gutter. Many changes, modifications, variations and other uses and applications of the subject invention will, however, become apparent to those skilled in the art after considering this specification and the accompanying drawings which disclose the embodiments thereof. All such changes, modifications, variations and other uses and applications which do not depart from the spirit and scope of the invention are deemed to be covered by the invention, which is to be limited only by the claims which follow.

What is claimed is:

1. An apparatus for a rain gutter having a lip, said apparatus comprising:

a gutter protector having a top portion, a vertical portion having an aperture, and a flange having a front portion and a back portion; and a clip having a first portion and a second portion, wherein said first portion is for resting on the lip of the gutter and wherein said second portion extends from said first portion, where said second portion is for coupling to the flange of the gutter protector to secure the gutter protector to the rain gutter, and wherein said second portion is for passing through said aperture of said gutter protector.

2. The apparatus of claim 1, wherein said first portion is a substantially flat portion and said second portion is a substantially curved portion.

3. The apparatus of claim 1, wherein said second portion comprises a nodule for engaging the front portion of the flange.

4. The apparatus of claim 1, wherein said first portion contains one or more apertures for receiving a fastener to couple the lip of the gutter to the flange of the gutter protector.

5. The apparatus of claim 1, wherein the gutter protector includes a wall that elevates said aperture from the lip of the rain gutter, and wherein said second portion includes one or more sides for allowing said second portion to pass through said elevated aperture.

6. The apparatus of claim 5, wherein said second portion comprises a nodule for engaging the front portion of the flange.

7. The apparatus of claim 6, wherein said first portion contains one or more apertures for receiving a fastener to couple the lip of the gutter to the flange of the gutter protector.

8. An apparatus for a rain gutter having a lip, said apparatus comprising:

a gutter protector having a top portion, a vertical portion having an aperture, and a flange having a front portion and a back portion; and a clip having a first portion and a second portion, wherein said first portion is for resting on the lip of the gutter and wherein said second portion extends from said first portion, where said second portion is for coupling to the flange of the gutter protector to secure the gutter protector to the rain gutter, wherein said second portion comprises a first side, a second side and a third side, where said first side is for extending around and beneath the lip of the rain gutter, while said second side is for extending around and underneath the flange of the gutter protector and said third side is for engaging the back portion of the flange of the gutter protector.

9. The apparatus of claim 8, wherein said third side has a hook shaped end.

10. The apparatus of claim 8, wherein said first side comprises a nodule for engaging an end of the lip of the rain gutter.

11. The apparatus of claim 10, wherein said first portion comprises a second nodule for engaging a top surface of the lip of the rain gutter.

12. The apparatus of claim 8, wherein said apparatus is formed from spring steel.

13. An apparatus for securing a gutter protector having a flange to a rain gutter having a lip, where said flange has a front portion and a back portion, said apparatus comprising:

a first portion for resting transversely on the lip of the gutter; and a second portion extending from said first portion, where said second portion is for coupling to the flange of the gutter protector to secure the gutter protector to the rain gutter, wherein said second portion comprises a first side, a second side and a third side, where said first side is for extending around and beneath the lip of the rain gutter, while said second side is for extending around and underneath the flange of the gutter protector and said third side is for engaging the back portion of the flange of the gutter protector, wherein said first side comprises a nodule for engaging an end of the lip of the rain gutter, wherein said first portion comprises a second nodule for engaging a top surface of the lip of the rain gutter and wherein said first portion contains one or more apertures for receiving a fastener to couple the lip of the gutter to the flange of the gutter protector.

14. An apparatus for a rain gutter having a lip, said apparatus comprising:

a gutter protector having a top portion, a vertical portion having an aperture, and a flange having a front portion and a back portion; and a clip having a first substantially flat portion and a second substantially curved portion, wherein said first substantially flat portion is for resting on the lip of the gutter; and wherein said second substantially curved portion extends from said first portion, where said second portion comprises a first side, a second side and a third side, where said first side is for extending around and beneath the lip of the rain gutter, while said second side is for extending around and underneath the flange of the gutter protector and said third side is for engaging the back portion of the flange of the gutter protector.

* * * * *